US005592714A

United States Patent [19]

Bernard

[11] Patent Number: 5,592,714

[45] Date of Patent: Jan. 14, 1997

[54] LOTION APPLICATOR

[76] Inventor: David N. Bernard, P.O. Box 2148, Pace, Fla. 32571

[21] Appl. No.: 584,257

[22] Filed: Jan. 11, 1996

[51] Int. Cl.[6] ..... B05C 17/02

[52] U.S. Cl. ..... 15/230.11; 15/143.1; 15/144.3; 15/145; 15/244.1

[58] Field of Search ..... 15/143.1, 144.1, 15/144.3, 145, 230.11, 244.1

[56] References Cited

U.S. PATENT DOCUMENTS

| | | | |
|---|---|---|---|
| 2,294,631 | 9/1942 | Rocca | 15/145 |
| 3,568,237 | 3/1971 | Rhodes . | |
| 4,263,690 | 4/1981 | Dobosi | 15/145 |
| 4,299,005 | 11/1981 | Brown | 15/244.2 |
| 4,308,879 | 1/1982 | Thornbloom . | |
| 4,899,417 | 2/1990 | Schaffer et al. | 15/230.11 |
| 4,934,001 | 6/1990 | Landreth | 4/615 |
| 5,105,500 | 4/1992 | Bordogna | 15/230.11 |

FOREIGN PATENT DOCUMENTS

| | | | |
|---|---|---|---|
| 416776 | 9/1934 | United Kingdom | 15/143.1 |
| 2203066 | 10/1988 | United Kingdom | 15/230.11 |

*Primary Examiner*—Mark Spisich
*Attorney, Agent, or Firm*—Joseph N. Breaux

[57] ABSTRACT

A lotion applicator of the type for applying lotion to body areas not easily reached is provided. The lotion applicator includes: an angled handle having a first end section, a middle section and a second end section; an elongated stem connected to and extending from the first end; an applicating member rotatably mounted on the elongated stem; and a tubular member having a first open end and a second closed end, the first open end being connectable to the first end section of the handle for storing the applicating member therein and connectable to the second end section for extending the length of the handle.

20 Claims, 1 Drawing Sheet

LOTION APPLICATOR

TECHNICAL FIELD

The present invention relates to devices for applying lotions and the like to areas of the body and more particularly to devices for applying lotions and the like to areas of the body that aide the user in applying the lotion to areas of the body that are difficult to reach, such as the back.

BACKGROUND ART

Often a person has the desire and/or need to apply a lotion such as medication, suntan oil or the like on an area of the body. This process often proves difficult when trying to apply the lotion to the back area without the aide of another person. Applying lotion is also a messy process, resulting in getting the lotion all of your hands and anything touched.

There are long handled scrubbers which may be used for reaching these areas. However, these devices require the user to be a contortionist, stretching his arms behind his head and around his sides to get the brush where it is needed. In addition, after use these devices collect dirt and debris.

It would be a benefit, therefore, to have a lotion applicator that has a rotating applicating member that dispenses the applied lotion by rolling of areas of the user's body. It would be a further benefit to have a lotion applicator that has an angled handle aiding the user in reaching these hard to reach body areas with less stretching. It would be a still further benefit to have a tubular member which may be connected to one end of the handle extending the reach when applying lotion and connected to the other end of the handle storing the applicating member therein when not being used.

GENERAL SUMMARY DISCUSSION OF INVENTION

It is thus an object of the invention to provide a lotion applicator that has an applicating member that rotates.

It is a further object of the invention to provide a lotion applicator that has a tubular member connectable to the device for aiding the user in applying lotions to body areas not easily reached, such as the back.

It is a still further object of the invention to provide a lotion applicator that has an tubular member in which the applicating member can be stored when not in use.

It is a still further object of the invention to provide a lotion applicator that has an angled handle to aide the user in applying lotions to body areas not easily reached, such as the back.

Accordingly, a lotion applicator of the type for applying lotion to body areas not easily reached is provided. The lotion applicator includes: an angled handle having a first end section, a middle section and a second end section; an elongated stem connected to and extending from the first end; an applicating member rotatably mounted on the elongated stem; and a tubular member having a first open end and a second closed end, the first open end being connectable to the first end section of the handle for storing the applicating member therein and connectable to the second end section for extending the length of the handle.

The handle is a cylindrical piece constructed of plastic. The first end section extends from the middle section at an angle, measured between the middle section and the first end section, of at least 90 degrees. Preferably, the handle is angled between 90 and 160 degrees. The handle is angled to aide the user in applying lotion to body areas not easily reached. The angle reduces stretching and contortionist like moves usually required in applying lotions to these areas.

The stem extends from the face of the first end section along the longitudinal axis thereof. The stem has a retaining end from holding the applicating member on the stem and a neck end connected to the handle. The stem and handle may be constructed of one piece. Preferably, the stem is a separate piece from the handle. More preferably, the stem is removably connected to the handle so that the applicating member may be replaced.

The applicating member may be any material which is porous, fibrous and suited for applying a lotion. The applicating member may be any type of natural or synthetic sponge. Preferably, the applicating member is cylindrical to facilitate the member rotating while applying lotion.

The tubular member is elongated and constructed of a rigid plastic. The open end of the tubular member is sized so as to frictionally pass either the first or second end section therein. Preferably, the open end is sized so as to frictional pass the end sections of the handle therein connecting the tubular member to the handle.

The tubular member may also have a raised protrusion adjacent the open end. The raised protrusion would be sized to accept either a first or a second detent. The first detent would be located on the first end section of the handle and the second detent would be located on the second end section. The detents may be a raised hump. Preferably, the detents are depressible, spring operated balls, well known in the art, to prevent wear and tear on the tubular member from connecting to and disconnecting from the handle. When an end section is disposed into the tubular member and the detent is lodged into the raised protrusion, the tubular member is securely connected to the handle preventing the handle from rotating in relation to the tubular member. This manner of interconnecting the handle and tubular member may also be used with a frictional fit of the open end over the end sections.

Preferably, the first and second end sections of the handle have equivalent diameters. More preferably, the end sections have equivalent diameters less than that of the middle section so that when the tubular member is connected it appears to be continuous with the middle section.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXAMPLARY MODE FOR CARRYING OUT THE INVENTION

Figure 1:
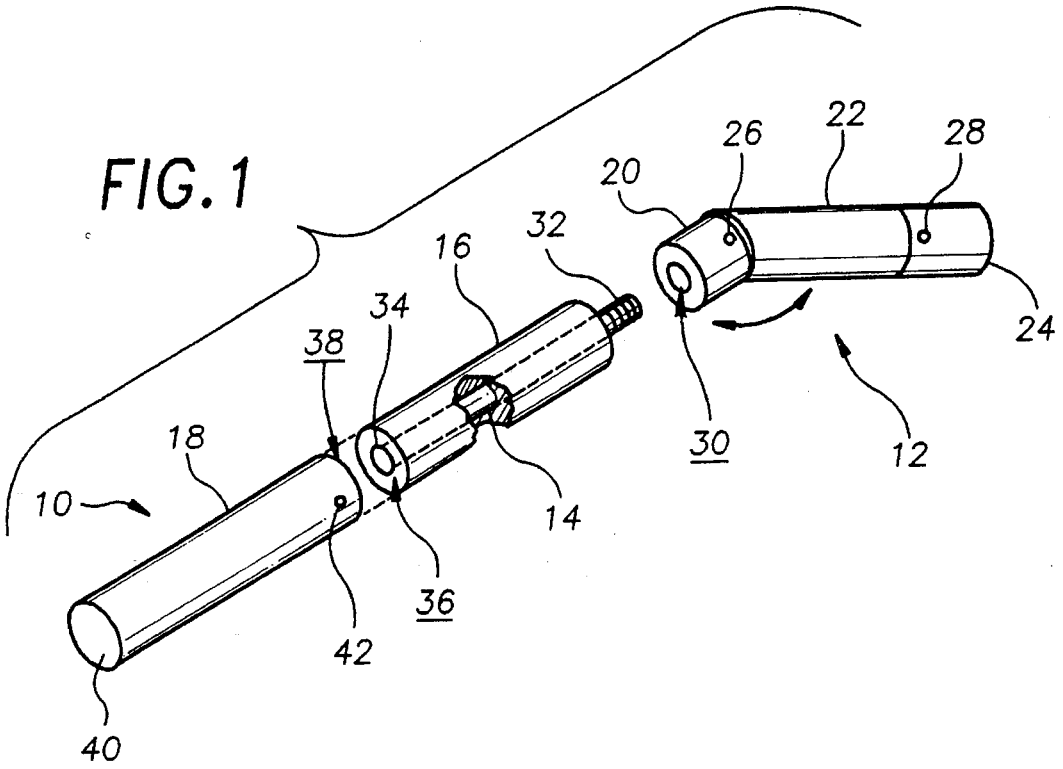
FIG. 1 is an exploded view of an exemplary embodiment of the lotion applicator of the present invention.

FIG. 1 is an exploded view of an exemplary embodiment of the lotion applicator of the present invention generally designated by the numeral 10. Lotion applicator 10 includes an angled handle 12, an elongated stem 14, an applicating member 16 and a tubular member 18.

Handle 12 has a first end section 20, a middle section 22 and a second end 24. Handle 12 is cylindrical and constructed of polyethylene. First end section 20 extends from middle section 22 at an angle of approximately 130 degrees, as shown by the arrow. First end section 20 and second end section 24 are of the same diameter, the diameter being less than that of middle section 22. First end section 20 forms a hole 30, along its longitudinal axis, having internal threading.

Located on a side of first end section 20 is a first detent 26. A second detent 28 is located on a side of second end section 24. First and second detents 26, 28 are depressible, spring operated balls spaced an equal distance from middle section 22.

Elongated stem 14 is constructed of a rigid plastic. Elongated stem 14 has an externally threaded neck end 32 adapted for threading into hole 30. Stem 14 has a retainer end 34 which is a ball formed on the end of stem 14 opposite neck end 32.

Applicating member 16 is an elongated, cylindrical porous sponge. Applicating member 16 forms a stem pathway 36 along its longitudinal axis. Applicating member 16 is rotatably mounted on stem 14 by disposing stem 14 through stem pathway 36, thereby retaining it between retainer end 34 and neck end 32 when stem 14 is connected to first end section 20.

Tubular member 18 is constructed of polyethylene. Tubular member 18 has a first open end 38 sized to frictionally dispose both first and second end sections 20, 24 of handle 12 and a second closed end 40. A raised protrusion 42 is formed by tubular member 18 adjacent open end 38. Raised protrusion 42 is spaced from first open end 38 a distance equal to the distance that first and second detents 26, 28 are spaced from middle section 22 of handle 12. Protrusion 42 is sized to disposed first and second detents 16, 28 therein.

Tubular member 18 may be used both to cover applicating member 16 and as an extension for handle 12. When used as a cover, applicating member 16 is inserted into tubular member 18 frictionally disposing first end section 20 into first open end 38 depressing first detent 26. Tubular member 18 is locked in place by first detent 26 lodging in protrusion 42.

Figure 2:
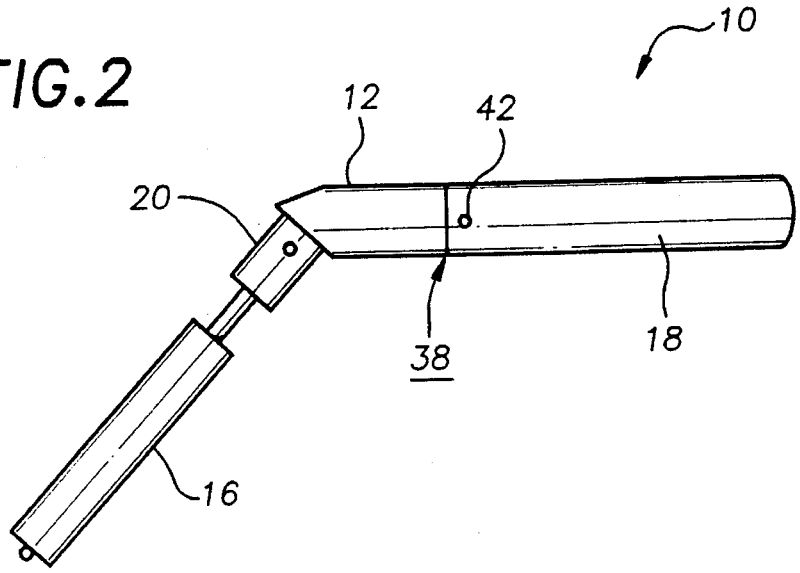
FIG. 2 is an elevated, perspective view of the lotion applicator.

FIG. 2 is an elevated, perspective view of lotion applicator 10. When used as an extension for handle 12, as shown in FIG. 2, tubular member 18 is disconnected from first end section 20 of handle 12 exposing applicating member 16. Second end section 24 (FIG. 1) of handle 12 is then frictionally disposed within first open end 38 of tubular member 18. Tubular member 18 is then rotated until second detent 28 (FIG. 1) is lodged in raised protrusion 42, thus, locking tubular member 18 in place and preventing handle 12 from rotating in tubular member 18 when applying lotion.

Use of lotion applicator 10 is now described with reference to FIGS. 1 and 2. First stem 14 is disposed into stem pathway 36 so that applicating member 16 is rotatably mounted between neck end 32 and retainer end 34. Neck end 32 is threaded into hole 30 formed by first end section 20 of handle 12. Lotion applicator 10 is then ready for use. To use lotion applicating member 10, lotion is placed on applicating member 16. Grasping handle 12 lotion is applied by rolling applicating member 16 against the area of the body desired. For hard to reach areas such as the back, tubular member 18 may be connected to second end section 24 of handle 12 increasing the user's reach. The curvature of handle 12 further aides the user by allowing him to reach his back without having to put his hand and arm over his shoulders, around his sides or behind his back. After use tubular member 18 may be connected to first end section 20 with applicating member 16 disposed therein, preventing dust and dirt from collecting on applicating member 16 and without getting lotion on the surroundings.

It can be seen from the preceding description that a device for applying lotions and the like to areas of the body which has an applicating member that rotates, a tubular member connectable to the device for aiding the user in applying lotions to body areas not easily reached, such as the back, a tubular member in which the applicating member can be stored when not in use, and an angled handle to aide the user in applying lotions to body areas not easily reached, such as the back has been provided.

It is noted that the embodiment of the lotion applicator described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lotion applicator comprising:

an angled handle having a first end section, a middle section and a second end section;

an elongated stem having a neck end and a retainer end, said retainer end being connected to said first end section of said angled handle;

an applicating member rotatably mounted on said elongated stem between said neck end and said retainer end; and a tubular member having a first open end and a second closed end, said first open end being connectable to said first end section for storing said applicating member therein and connectable to said second end section for extending said handle.

2. The lotion applicator of claim 1, wherein:

said first end section extends from said middle section of said handle at an angle between 90 degrees and 150 degrees.

3. The lotion applicator of claim 1, wherein:

said first end section extends from said middle section of said handle at an angle between 110 degrees and 140 degrees.

4. The lotion applicator of claim 1, wherein:

said first end section has a diameter less than that of said middle section; and said second end section has a diameter equivalent to that of said first end section.

5. The lotion applicator of claim 4, wherein:

said open end of said tubular member is sized to frictionally dispose said first end section and said second end section of said handle therein.

6. The lotion applicator of claim 1, wherein:

said applicating member is a fibrous, porous material.

7. The lotion applicator of claim 6, wherein:

said applicating member is cylindrical.

8. The lotion applicator of claim 1, further including:

a first detent located on a side of said first end section of said handle;

a second detent located on a side of said second end section of said handle; and a raised protrusion formed by said tubular member adjacent said open end.

9. The lotion applicator of claim 8, wherein:

said first and said second detents are depressible spring operated balls.

10. The lotion applicator of claim 2, wherein:

said first end section has a diameter less than that of said middle section; and said second end section has a diameter equivalent to that of said first end section.

11. The lotion applicator of claim 2, wherein:

said applicating member is a fibrous, porous material.

12. The lotion applicator of claim 2, further including:

a first detent located on a side of said first end section of said handle;

a second detent located on a side of said second end section of said handle; and a raised protrusion formed by said tubular member adjacent said open end.

13. A lotion applicator comprising:

an angled handle having a first end section extending at an angle from a middle section and a second end section, said first end section and said second end section having equivalent diameters, said end section diameters being less than that of said middle section;

an elongated stem having a neck end and a retainer end, said retainer end being connected to said first end section of said angled handle;

a fibrous, porous applicating member rotatably mounted on said elongated stem between said neck end and said retainer end; and a tubular member having a first open end and a second closed end, said first open end being connectable to said first end section for storing said applicating member therein and connectable to said second end section for extending said handle.

14. The lotion applicator of claim 13, wherein:

said first end section extends from said middle section of said handle at an angle between 90 degrees and 160 degrees.

15. The lotion applicator of claim 14, wherein:

said first end section extends from said middle section of said handle at an angle between 110 degrees and 140 degrees.

16. The lotion applicator of claim 13, further including:

a first detent located on a side of said first end section of said handle;

a second detent located on a side of said second end section of said handle; and a raised protrusion formed by said tubular member adjacent said open end.

17. A lotion applicator comprising:

an angled handle having a first end section extending at an angle from a middle section and a second end section, said first end section and said second end section having equivalent diameters, said end section diameters being less than that of said middle section;

a first detent located on a side of said first end section of said handle;

a second detent located on a side of said second end section of said handle;

an elongated stem having a neck end and a retainer end, said retainer end being connected to said first end section of said angled handle;

a fibrous, porous, cylindrical applicating member rotatably mounted on said elongated stem between said neck end and said retainer end; and a tubular member having a first open end and a second closed end, said first open end being connectable to said first end section for storing said applicating member therein and connectable to said second end section for extending said handle; and a raised protrusion formed by said tubular member adjacent said open end.

18. The lotion applicator of claim 17, wherein:

said first end section of said handle forms a hole along its longitudinal axis having internal threading; and said neck end of said elongated stem has external threading adapted for threading into said hole formed by said first end section.

19. The lotion applicator of claim 18, wherein:

said first end section extends from said middle section of said handle at an angle between 90 degrees and 160 degrees.

20. The lotion applicator of claim 18, wherein:

said first end section extends from said middle section of said handle at an angle between 110 degrees and 140 degrees.

* * * * *